United States Patent [19]

Lautzenheiser et al.

[11] 4,412,211

[45] Oct. 25, 1983

[54] SYSTEM FOR TEST SEQUENCE ANNUNCIATION

[75] Inventors: William J. Lautzenheiser, North Billerica, Mass.; Richard A. Simonetti, Baldwin Harbor, N.Y.; Martin E. Henderson, Wayland, Mass.; James B. Edson, Concord, Mass.; Kenneth E. Beeson, Waltham, Mass.

[73] Assignee: American District Telegraph Co., New York, N.Y.

[21] Appl. No.: 297,330

[22] Filed: Aug. 28, 1981

[51] Int. Cl.[3] ..... G08B 29/00

[52] U.S. Cl. ..... 340/514; 340/541

[58] Field of Search ..... 340/514, 541; 367/93, 367/94

[56] References Cited

U.S. PATENT DOCUMENTS

| | | | |
|---|---|---|---|
| 3,487,404 | 12/1969 | Midkiff | 340/541 X |
| 3,781,859 | 12/1973 | Hermans | 340/514 X |
| 3,846,782 | 11/1974 | Brodsky | 340/514 X |
| 4,138,674 | 2/1979 | Humphries | 340/514 X |

FOREIGN PATENT DOCUMENTS

| | | |
|---|---|---|
| 961949 | 6/1964 | United Kingdom . |
| 1206954 | 9/1970 | United Kingdom . |
| 1386223 | 3/1975 | United Kingdom . |
| 1564570 | 4/1980 | United Kingdom . |
| 2054923 | 2/1981 | United Kingdom . |

*Primary Examiner*—David L. Trafton

*Attorney, Agent, or Firm*—Weingarten, Schurgin, Gagnebin & Hayes

[57] ABSTRACT

A system for providing a distinctive indication that a system, such as a security system, is in a test mode in which the distinctive indication includes audible and/or visual indications that a test sequence has been initiated, followed by testing of the system during the test sequence, with test results being indicated by altering the format of the audible or visible signal. In one embodiment involving a security system, a periodic signal is changed to a steady state signal when a sensor has been violated, thereby to provide a reminder that the system is in the test mode followed by instantaneous communication to the user of not only the operability of the sensor but also both the transmission of the sensor's output to a central control unit and the operability of this control unit itself.

13 Claims, 5 Drawing Figures

SYSTEM FOR TEST SEQUENCE ANNUNCIATION

FIELD OF THE INVENTION

This invention relates to signaling systems and more particularly to a system which provides an audible or visible indication that the signaling system is under test along with an indication of the result or results of the test.

BACKGROUND OF THE INVENTION

Security systems have been devised in the past in which a number of sensors such as ultrasonic, microwave, switch contact, fire security, etc., are coupled by a multi-wire cable to a central control unit. The central control unit in many instances has local annunciation in terms of a sounder which provides an audible indication of an alarm condition signal having been transmitted to the central control unit. Additionally, the central control unit may have an annunciation of the location of the sensor producing the alarm condition indicating signal. Moreover, many of these security systems are provided with means for testing the system in which, for instance, an off-premises telephone dialer is inhibited so that the system may be tested without transmission to a fire station, a police station or off-premises security office.

While various previous security systems have sensors at which are located lights which are made to flash when the particular sensor has been violated, such as by passing in front of an ultrasonic sensor, it is not clear from a walk test of such sensors that the output of the sensor is, in fact, being communicated to the central control unit utilized for such a sensor. Nor is it clear that the central control unit is operative to process the alarm condition signal. Compromise of the system between the sensor and the control unit includes, for instance, cable tampering, either intentional or accidental, and a walk test while giving a degree of certainty as to the operability of the sensor itself, does not provide an indication of the communication of the sensor's output to a central unit and beyond.

Perhaps a more important problem with the testing of security systems is the lack of constant reminder that the system is in the test mode. While systems in the past have provided test indicator lamps at a central control panel, when personnel are engaged in testing of the system at points remote from the panel, there is no indication that the system is in a test mode in which alarms are inhibited and in which communication to the outside world has been temporarily cut. Thus, for instance, should a fire occur while the system is in a test mode, personnel not aware of the system being in a test mode might assume that the fire alarm indicating signal had, in fact, been sent off-premises.

The problem is compounded when, as is the usual case, the burglar alarm/fire alarm control unit is completely disabled and a separate test unit is connected to the system in order to test the entire system. While the test unit itself may be located adjacent the control unit, there is no necessity for co-locating the units and if the system test lamps are only located at the test unit control panel, the fact of the system being in the test mode will not be communicated to other personnel, either at the central control unit or elsewhere in the protected facility.

It is, of course, possible that the individual initiating the test sequence will forget that the system has been placed in a test mode and will leave the premises. In such a case the premises are left with no protection at all, since the major system functions have been inhibited to enable the test.

SUMMARY OF THE INVENTION

In the subject system, a highly audible and/or visible indication that the system has been placed in the test mode is provided in the form of a signal transmitted throughout the area under test once the test sequence has been initiated. In a preferred embodiment, this highly recognizable indication is a loud periodic beeping sound which is audible throughout the protected facility so that anybody within the protected facility will recognize that the system is under test. Thereafter, any normal method of testing is carried out, with the periodic beeping or distinctive signal being changed in format to, for instance, a steady state signal upon a favorable test result. Thus what is provided is an alterable test mode reminder signal. In the case of a security system having sensors coupled to a control unit, the actuation or so called "violation" of a given sensor provides for a change in the signal format. Thus, for instance, an individual can place the system in the test mode and then perform a walk test in which various sensors are violated, with the change in signal format giving the individual an indication not only that the sensor is operating to detect his presence but also the fact that the resulting alarm condition signal has, in fact, been transmitted back to an operating control unit.

In order to keep track of the sensors which have been tested, an indicator at the control unit may be latched ON to indicate that the particular sensor has been tested and has performed properly. More importantly, the change in audible or visible signal format for each violated sensor provides that the alterable test mode reminder signal follows the person making the walk test. Thus, for instance a switch contact may be broken with entrance through a door, which sensor violation is indicated by a steady tone. After the individual has walked through the doorway, the door is closed and the steady tone then returns to a beeping tone. This followed by another steady tone indication when, for instance, the individual enters an area protected by an ultrasonic sensor. Thereafter, the individual may manually actuate a fire detection sensor, the actuation being indicated by a steady state tone. In any event, the distinctive test mode signal is changed to another highly recognizable signal as the individual performs the walk testing.

The audible or visible indications of a test mode sequence and sensor actuation may be provided by sounders or lights at the central and the remotely located control units, or these indicators may be located throughout the protected facility. For residential applications it has been found that a sounder at a central control unit can provide sufficient coverage for the entire residence, with any remote sensors at a garage for instance, being testable at the very least by the latching of the appropriate alarm condition indicator even if the alterable test mode signal is not audible or visible at the remote location.

In one embodiment, access to the system for purposes of test is provided by the entry of a predetermined pass code at a key pad or the use of a key. Upon the first entry of a pass code and actuation of a test button, off-premises transmission may be inhibited and sounders at either a central control unit and/or remotely located control unit as well as the lights are actuated in a steady state for a predetermined length of time to permit checking the operability of not only lights and sounders, but also that predetermind portions of the system are also operative. This is a self-test sequence used prior to the full test. What may be tested during the initial self-test period is, for instance, the operation of system clocks and oscillators, the operation of shift registers, the operation of power supplies, etc. Thus, in an initial period, test mode annunciators are actuated to see if they working, with the annunciators also providing an indication that selected internal circuits are also in operating order.

After an initial self-test period in which the individual actuating the test sequence can determine that system function indicators are operative, the system can be designed to automatically go into a test mode, in which a distinctive signal is produced to remind the individual and anybody on the premises that the system is in a test mode.

During the normal test procedure, all sensors may be actuated in which the detected actuation of a sensor changes the format of the test mode indication to some other format, such as a steady state signal, while at the same time latching an indication of the identity of a successfully tested sensor. What this mens is that every sensor which has been actuated or violated during the test sequence is annunciated at a control panel so as to give an indication of which sensors have, in fact, been actuated and found operative.

While a successful test indication is latched, the audible or visual indication of the actuation of the sensor ceases after the sensor has been deactivated, either by walking out of the room, closing the door, etc. This provides a further level of protection since if the sensor is not deactivated, which would be the case when a door is not subsequently closed, the system would not return to its original test mode indicating signal, but would rather remain in the steady signal to indicate a system malfunction.

At any time after the system is placed in a test mode a user may wish to test alarm condition annunciators such as alarm sirens as well as test mode annunciators. He may not initially wish to activate the alarm sirens for every test since in residential settings this would be unacceptable at some hours. However, at permissible times, it is important to test the alarm condition annunciators. In one embodiment this is accomplished by a second or subsequent test button actuation in which the sounders on the control unit are actuated, the lights or other visual indicators on the control units are actuated, and in addition, local alarm condition annunciators are actuated. Alarm condition annunciators include sirens on the outside of the premises or strobe lights.

In a still further embodiment, the system may be removed instantaneously from the test mode by the entry of the predetermined pass code or access code at any remotely located control unit or the central control unit. Thus, for instance, should a fire or burglary be taking place during the test mode sequence, any individual witnessing such an event could terminate the test mode immediately, thereby sending the alarm condition indication either off-premises or to the on-premises location at which there are monitoring personnel.

By so doing, a test mode reminder signal is provided which provides all personnel in a facility with an indication that a test mode sequence is in operation. This level of security is provided regardless of the size of the facility monitored, regardless of the location of the control unit and regardless of the number of personnel in the facility. Secondly, change in format of the test mode signal by virtue of testing not only sensor violation but the actual transmission of an alarm condition signal to the control unit provides a further level of certainty of the operability of the system in that the individual making the test is assured not only of the operability of the sensors but is instantaneously apprised of the fact that the sensor is communicating with the control unit and that the control unit is processing the signals appropriately. The alterable test mode reminder signal thus provides an indication of the overall operability of the system.

While the above relates to security systems, it will be appreciated that the subject test sequence annunciation system is useful to indicate that other types of systems are under test, with the test reminder signal being altered in format responsive at any type criteria related to the test mode. Thus the results of a test made at locations remote from a control panel can be made available at the remote location. Additionally, more than one signal format can be used to annunciate the results of different tests.

BRIEF DESCRIPTION OF THE DRAWINGS

These and other features of the subject invention will be better understood in connection with the detailed description taken in conjunction with the drawings in which.

DETAILED DESCRIPTION OF THE DRAWING

Figure 1:
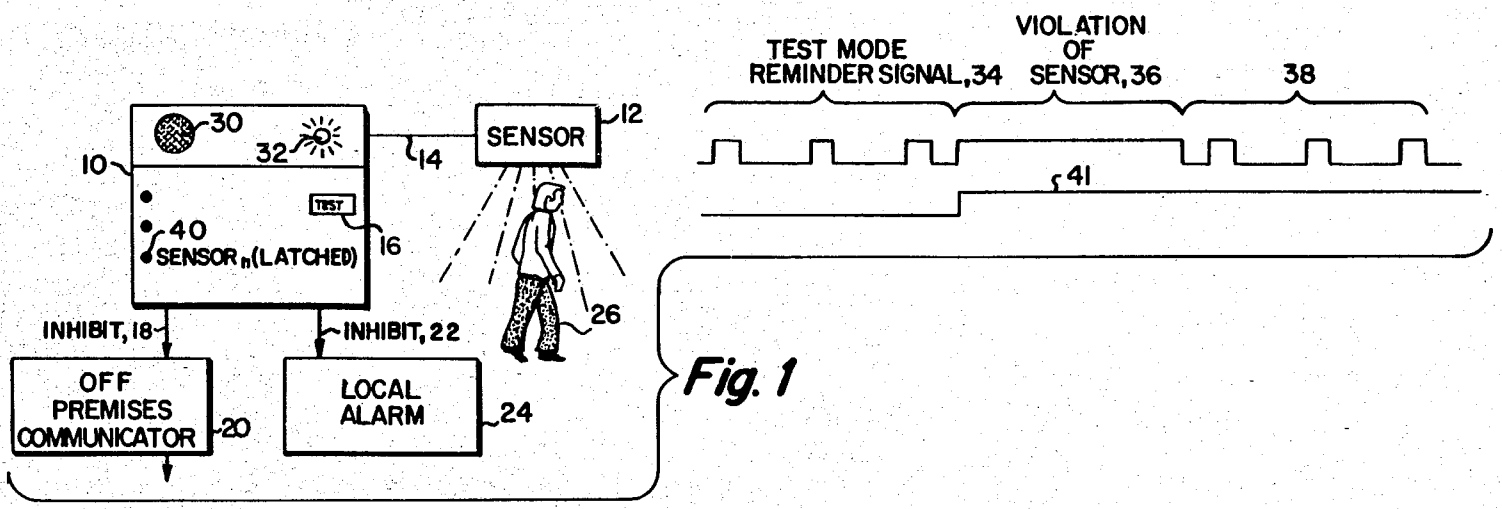
FIG. 1 is a diagramatic illustration of the utilization of a distinctive signal to indicate that a system has been placed in a test mode followed by an alteration in the format of the signal for a successful test.

Referring now to FIG. 1, a security system capable of being tested is provided with a control unit 10, a sensor 12 and a multi-wire cable 14 connecting the sensor to the control unit. A test button or switch 16 is actuatable at the control unit to place the security system in a test mode. Upon actuation of the security system in a test mode, an inhibit signal is applied over line 18 to an off-premises communicator 20 utilized to transmit alarm condition signals to off-premises locations such that an alarm condition signal and the type thereof may be transmitted to, for instance, a fire department, a police department or an off-premises security office. Additionally, with the actuation of test button 16, an inhibit signal over line 22 is utilized to inhibit local alarms 24 which may include local alarm annunciators such as sirens, strobe lights and the like.

Typically in a security system a walk test is performed by an individual here illustrated at 26 who, during the walk test, actuates or violates a sensor to ascertain the operability of a sensor. For volumetric sensors involving ultrasonic sensors, microwave sensors or passive infrared sensors, a sensor is violated merely by the presence of an individual within the protected area. For perimeter or point sensors, a sensor is violated by, for instance, the opening of a door, window or cover, the cutting of a wire or the tripping of a particular switch. For vibration sensors the violation of the sensor may include producing a simulated vibration.

As mentioned hereinbefore, it is important to give notice to personnel within the protected facility that the system which protects the facility is under test. This is accomplished in one embodiment through the utilization of a sounder 30 or high intensity light 32 which provides a highly distinctive test mode reminder signal upon actuation of the test mode sequence. In the embodiment illustrated the signals available either from the sounder or the light source may have a pulsed waveform such as illustrated by the periodic signal 34 or it may be chirped in that the frequency of the pulse is rapidly changed during its production. In any event, the distinctive signal is made available at all areas within the facility under test. For particularly loud sounders, depending on the size of the facility, this characteristic distinctive signal may be projected from one location into the facility. Alternatively, test mode reminder signals may be generated anywhere within the facility so as to assure that persons within the facility are on notice that the security system is under test.

Providing such a test mode reminder signal is extremely useful to alert personnel within the protected facility that the system under test is no longer, for instance, connected to off-premises monitoring stations. Moreover, it is a reminder to personnel within the premises that all alarms have been shut down. Should an emergency situation occur such as a fire or a burglary, the individual would want to apprise others of the situation either by returning the security system to its normal operating mode or through the utilization of some other means of communication.

Having reminded an individual that the security system is under test, in the usual test procedure an individual performs the aforementioned walk test thereby violating a succession of sensors. In the subject system the highly distinctive test mode reminder signal format is changed to another highly distinctive signal which is indicative of the sensed violation of a sensor. This signal may, for instance, be steady state signal 36 which, in a preferred embodiment, is produced during the time a sensor is violated. The change in format of the test mode reminder signal to a sensor violation provides the individual making the walk test with an indication of the results of the walk test, mainly that his presence has been sensed, that this fact has been communicated to a control unit and that the control unit is operating properly to detect the violation of the sensor. After the individual has satisfied himself of the operability of a particular sensor he deactivates the sensor either by removing himself from the area protected by the sensor or by some other deactivation routine whereby the test mode reminder signal is reestablished as illustrated at 38.

In one embodiment an indicator 40 at control unit 10 is latched simultaneously with the production of the sensor violation signal so as to provide an indication of which sensors have been tested and found operating during the walk test.

Should an individual fail for any reason to deactivate a sensor, the sensor violation signal would continue as illustrated at 41, until such time as the individual performing the walk test is able to deactivate the sensor. Thus the alteration in the format of the test mode reminder signal for a sensor violation provides a further testing level in that not only is the individual making the test assured of the actuation of the sensor, but he is also assured that he has successfully deactivated the sensor upon return of the distinctive test mode reminder signal. This prevents against the accidental failure to deactivate a sensor such as leaving a protected door ajar and permits the individual to take corrective action for either a malfunctioning sensor or an accidental situation caused by the walk test of the system.

Figure 2:
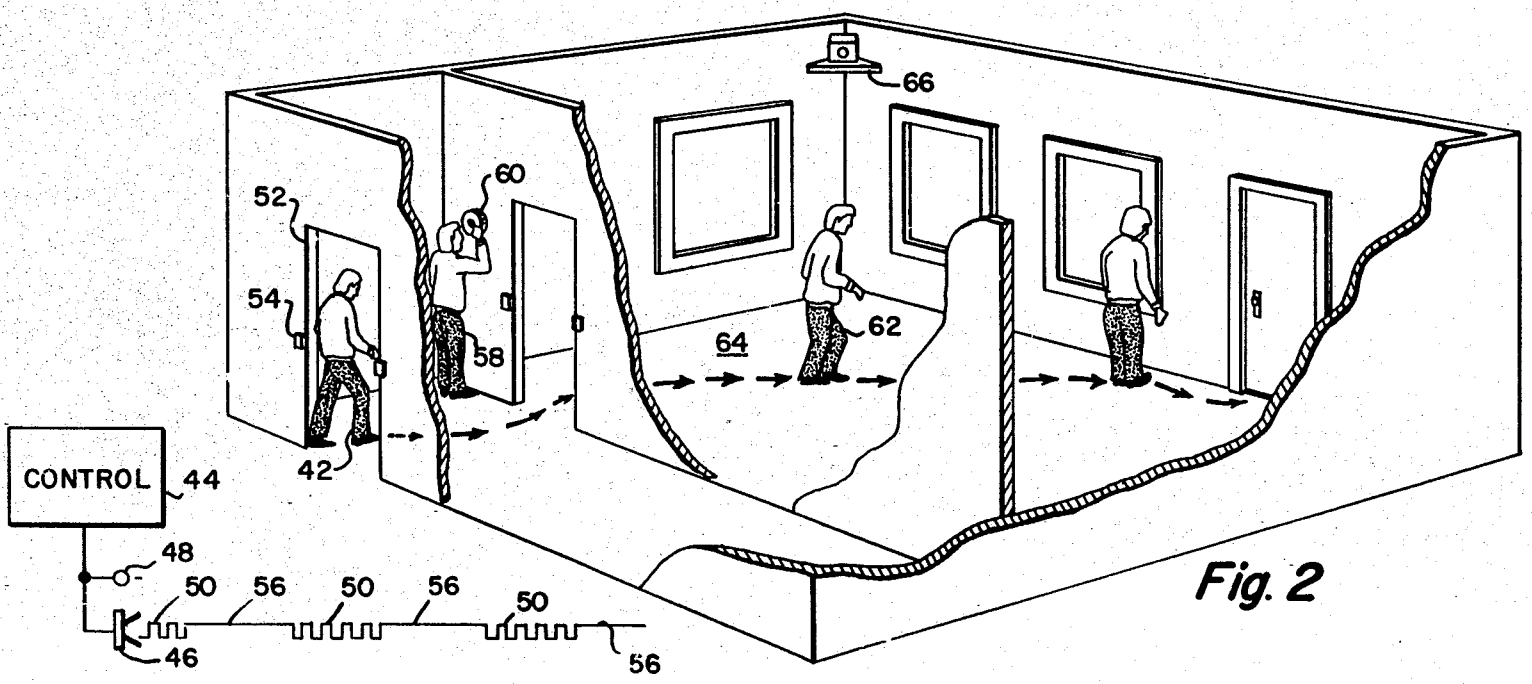
FIG. 2 is a diagramatic illustration of the walk testing of a facility protected by the system of FIG. 1.

As illustrated in FIG. 2, the test mode reminder signal/sensor violation signal follows the walk test in that the walk test provides the individual with an instantaneous indication of the results of sequential sensor violations. Thus, for instance, an individual at a position 42 may place the security system in a test mode at control unit 44 such that a sounder 46 or a light source 48 provides either an audible or visible signal 50 indicating initiation of a test mode sequence. The individual may then proceed to position 52 where the opening of a door as sensed at sensor 54 results in a sensor violation signal 56 being produced. After the door is closed the test mode reminder signal 50 is again produced and appears to follow the individual, for instance, to a position 58 where the individual may wish to test a second sensor 60 such as a smoke detector. In order to violate the smoke detector he actuates the sensor manually through the pushing of a test button. This results in a sensor violation signal 56 again being produced. The individual may then wish to deactivate the testing of the sensor by releasing the test button at which point test mode reminder signal 50 reappears. Thereafter, the individual may arrive at position 62 within a protected area 64 monitored by a volumetric sensor 66. Upon entry into the protected area a sensor violation signal 56 will again reappear. In this manner the test mode reminder/sensor violation signals are readily available to give the individual performing the walk test the results of the test and are therefore said to follow the individual through the walk test.

Figure 3:
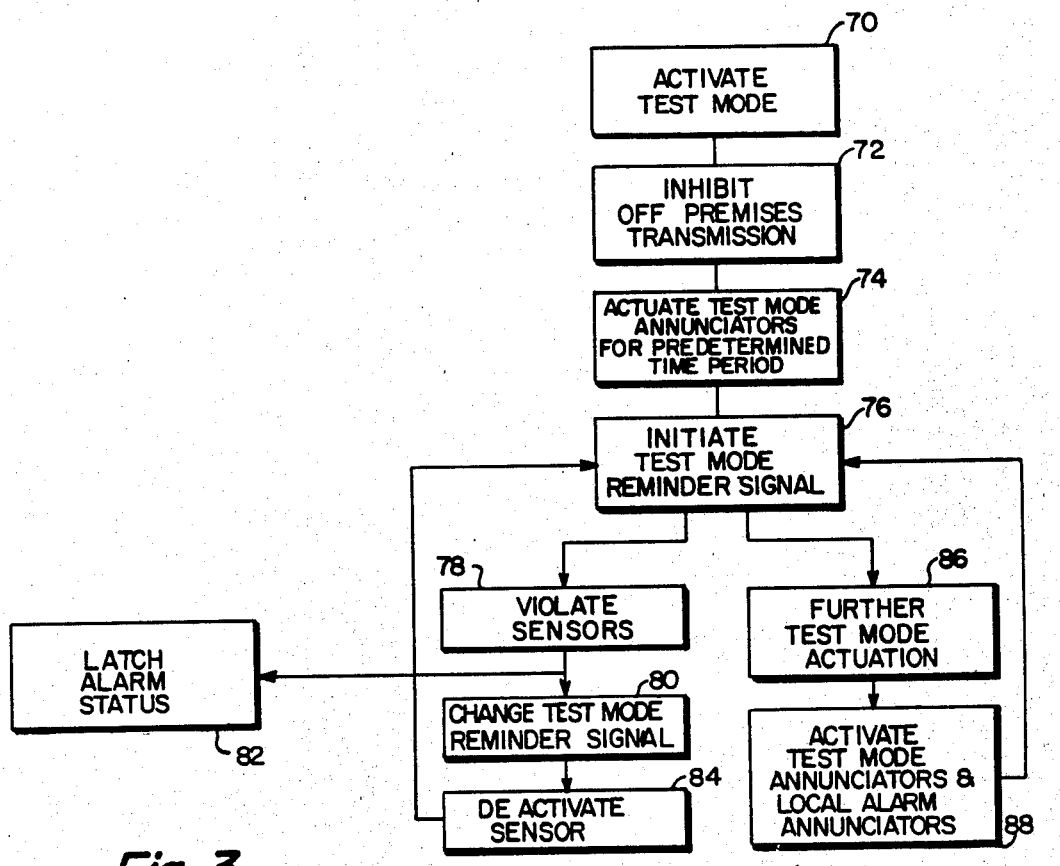
FIG. 3 is a flow diagram illustrating a test mode sequence involving actuation of test mode annunciators followed by the initiation of a test mode reminder signal.

Referring now to FIG. 3, a flow diagram illustrates one type of test mode sequence in which an additional indication of the viability of the security system may be obtained. In this embodiment a test mode may be actuated as illustrated at 70 by the actuation of a test mode switch which results as illustrated at 72 in inhibiting off-premises transmission. Thereafter, as part of a self-test, all test mode annunciators, both audible and visible, may be actuated as illustrated at 74 with a highly distinctive signal which may be a steady state signal with the actuation of being for a predetermined time period. The purpose of the actuation of the test mode annunciators as opposed to alarm condition annunciators is to permit an individual to test mode indicator lamps and test mode sounding systems. It may also be desirable to test certain system functions such as battery voltage, the operation of system clocks or the operability of other critical circuits.

After the temporary actuation of test mode annunciators, the normal test mode is initiated in which a test mode reminder signal is produced as illustrated at 76. Thereafter, sensors may be actuated or violated as illustrated at 78 which results in the change of the format of the test mode reminder signal as illustrated at 80. This also results in the latching of an alarm status indicator as illustrated at 82. Upon deactivation of the sensor as illustrated at 84 the test mode reminder signal is again initiated.

It is, however, possible to test not only the test mode annunciators but also the local alarm annunciators and this is accomplished through a second actuation of a test mode button such as illustrated at 86. Upon such further test mode actuation not only are the test mode annunciators actuated for a predetermined time but the local alarm annunciators are activated. Local alarm annunciators include, for instance, sirens, strobe lights, etc., with the system illustrated in FIG. 3 being configured to provide several different distinctive indications for different types of tests.

For instance, assuming a test mode reminder signal of a periodic chirped variety, assuming a sensor violation signal being of a steady state variety, it is possible to provide the test mode annunciators with a pulsed signal in which the pulse durations are considerably longer than the chirps associated with the test mode reminder signal. In so doing, the format of the test mode reminder signal may be altered in more than one way to provide more than one type of indication of the operability of a system.

Figure 4:
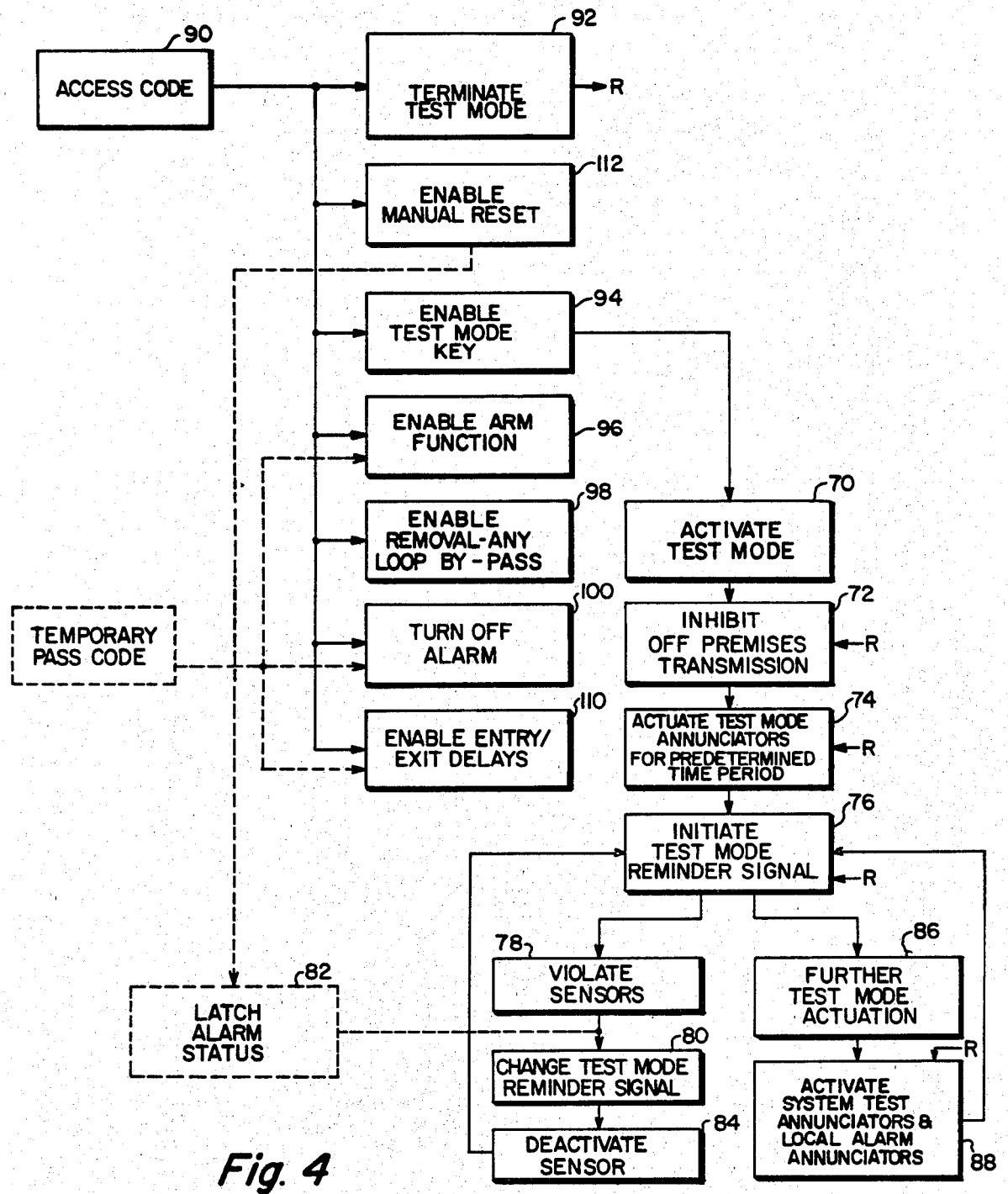
FIG. 4 is a flow diagram of a system which utilizes the test mode sequence of FIG. 3 in which the test mode is enabled through the entry of an access code, also illustrating the affect of the access code on several system functions, the utilization of a temporary pass code being illustrated as affecting only certain of the system functions.

Referring to FIG. 4, as is common in almost any type of security system, there is an access code or key which is utilized to arm the system. The access code may be entered as a pass code at a key pad or the access code may be given by the configuration of a particular key. In any event, in access code-type systems, an access code, here illustrated at 90, is utilized to terminate any previously existing test mode sequence as illustrated at 92. For test mode sequences the entry of the access code enables a test mode key or switch as illustrated at 94 while in the usual instance also enabling an arming function as illustrated at 96 whereby the entire system may be rendered operational. As a further function of the access code, it may operate to remove any loop by-pass instructions as illustrated at 98. Generally, the more sophisticated security systems operate with a number of loops each having one or more sensors which, for instance, protect different areas or provide different functions such as burglary detection, fire detection, medical emergency detection, perimeter penetration detection, etc. It is therefore useful for an access code to enable the removal of any previous loop by-pass instructions to the system.

Moreover, upon entry of an access code a usual function is to turn off all of the alarm condition annunciators as illustrated at 100 and also to enable entry/exit delays as illustrated at 110 so that access to the facility may be obtained. In addition, should a system test result in the latching of alarm status indicators as illustrated at 82, the entry of the access code may enable a manual reset as illustrated at 112 so that the results of a previous test can be erased. Moreover, entry of the access code may be utilized to enable any type of reset.

Additionally, a temporary pass code may be assigned to second level personnel, for instance maintenance personnel or char services, such as illustrated at 114 which controls only a portion of the functions of the security system, for instance, permitting these people to turn off the alarms and enable entry and exit delays, thereafter permitting this level of personnel to enable and arm the system after access. However, the utilization of the temporary pass code prohibits any other access to the system and therefore provides an additional level of security.

The actuation of the test mode key serves to actuate the test mode as illustrated at 70 and is as described in connection with FIG. 3. It will be noted that the access code is instantaneously able to cancel the test mode through the utilization of a reset pulse applied at 72, 74, 76 and 88, the function of which will be described hereinafter. It is an important feature of a system which utilizes an access code that the test mode sequence be interruptable. This works in combination with the provision of a test mode reminder signal so that anybody in the premises, having been reminded that the system is in test mode, can immediately deactuate the test mode and provide for local alarm annunciation and off-premises transmission.

What will now be described is one type system which provides for test annunciation, local alarm annunciation and a test mode reminder signal having a format alterable in response to the result of a system test.

Figure 5:
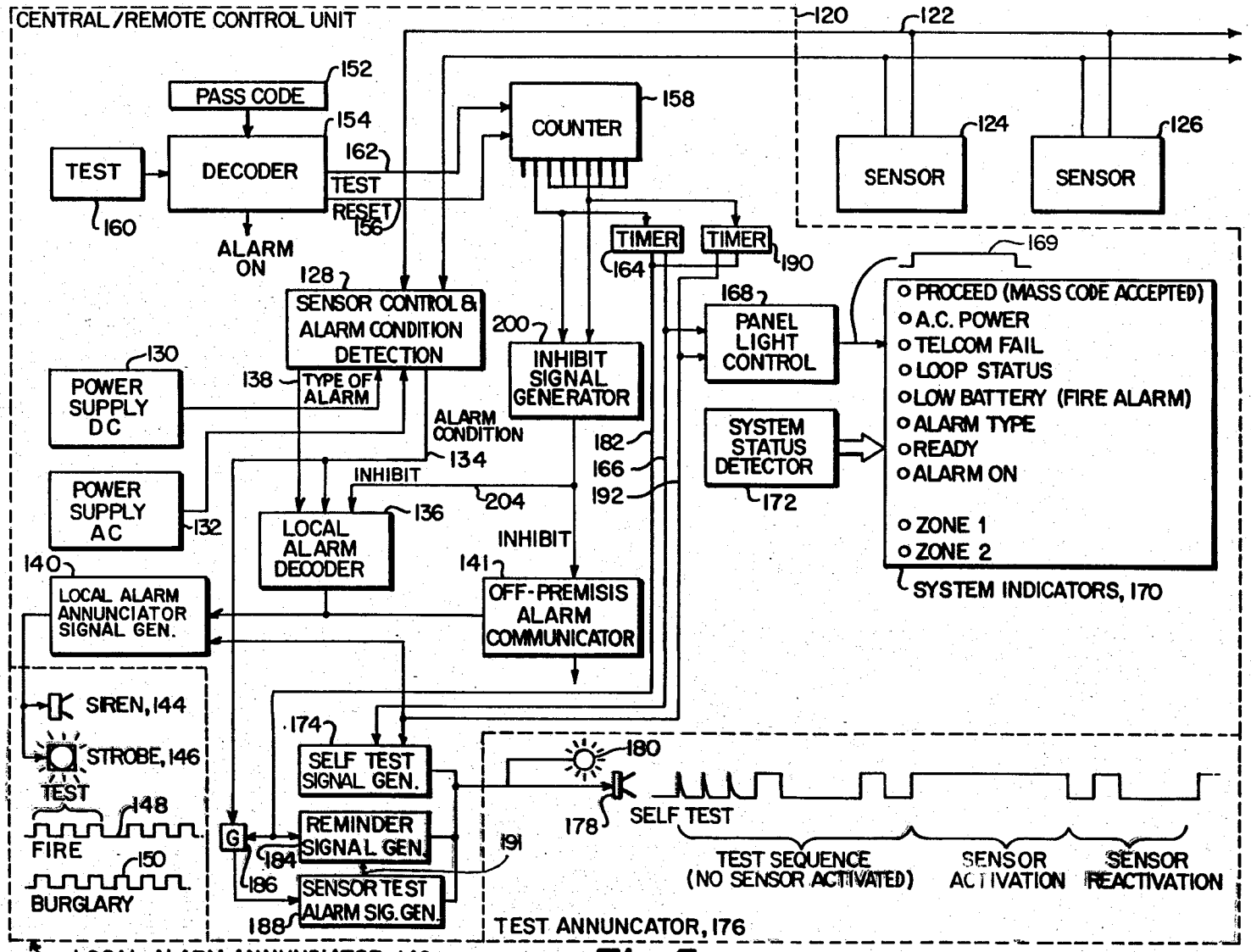
FIG. 5 is a block diagram illustrating one embodiment of the system of FIG. 4.

Referring now to FIG. 5, a central or remotely located control unit 120 is connected by a multi-wire cable 122 to sensors 124 and 126 which may respectively sense smoke indicative of a fire or intrusion indicative of a burglary. In normal operation, a sensor control and alarm condition detection unit 128 of conventional design couples DC power from DC power supply 130 and AC power from AC power supply 132 over the multi-wire cable to the sensors. It is the function of unit 128 to detect the outputs of the various sensors, to identify first that an alarm condition has occurred and secondly the type of alarm condition sensed. For instance, sensor 124 being a fire detection sensor may provide one type of alarm condition signal which is transmitted to the sensor control and alarm detection unit, whereas sensor 126, sensing an unauthorized intrusion provides a different type of an alarm condition signal. The output of sensor control and alarm condition detection unit 128 is a signal indicating the presence of an alarm condition. This signal is delivered over line 134 to a local alarm decoder unit 136. The type of alarm is also transmitted over line 138 to local alarm decoder 136. This decoder provides an output signal to a local alarm annunciation signal generator 140 and an off-premises alarm communicator 141. In one embodiment, generator 140 generates signals indicative of the type of alarm condition sensed. The information provided both to the local alarm annunciator and the off-premises alarm communicator is a signal which indicates that an alarm condition has been detected and the nature of the alarm condition. The output of generator 140 is applied to a local alarm annunciator 142 which may include, for instance, a siren 144 or a strobe light 146. The alarm annunciators produce signals which are characteristic of the type of alarm. For instance, as illustrated by waveform 148 a three-pulse series is provided on a repetitive basis by generator 140 to indicate that the particular alarm condition represented a fire. Alternatively, should the local alarm condition be the result of an intrusion indicative of a burglary, then pulses illustrated by waveform 150 would be provided by generator 140.

Having described the operation of a security system including local alarm annunciation, it is possible to provide the system with pass code access and a test sequence. This is accomplished as follows. A pass code generally indicated at 152 is entered into a decoder 154 which upon entry of an appropriate pass code provides a reset signal over line 156 to a counter 158. The entry of the pass code resets the counter in all cases. Moreover, the decoding of the appropriate pass code enables a test button or switch 160 the output of which is coupled to the decoder and when actuated in the presence of an appropriate pass code results in a signal over line 162 being applied to counter 158 to clock the counter from its reset condition so as to provide an output signal on output line number 1. This output signal is applied to a timer 164, the output of which over line 166 is applied for a predetermined time dictated by the timer to a panel light control 168 which is coupled to panel indicators 170 so as to actuate all panel indicators for a predetermined period of time 169 established by timer 164. This provides an indication that all the system indicators are operating. The system indicators are driven by a system status detector 172 which is coupled into the system so as to appropriately actuate indicators such as a "proceed" light when an appropriate pass code has been accepted, a light to indicate that AC power is being provided to the system, a light to indicate that there has been a failure in the off-premises alarm communicator, e.g. a telecommunications failure, a light to indicate loop status, that is, which loops are in fact operational, a light to indicate a low battery in the case of sensors which use batteries, a light to indicate the type of alarm which is sensed, a light to indicate that the system is in ready, a light to indicate an alarm or status, and lights to indicate zones from which an alarm condition has been sensed.

The output of timer 164 over line 166 is also applied to a self-test signal generator 174 which provides a series of spike pulses during the time interval established by timer 164. The output of generator 174 is applied to a test annunciator 176 which may include a sounder 178 or a light source 180.

It is the purpose of the first actuation of test button 160 that for a limited period of time not only is it possible to perform a self-test function in which all of the indicator lamps are lit, it is also possible to test the test annunciator, be it a sounder or light source. This is done automatically upon the first actuation of a test button 160.

When timer 164 times out, for instance, after three seconds, the signal is removed from line 166 which disables panel light control unit 168 thereby extinguishing the previously lit lamps. Also when timer 164 times out a signal is applied over line 182 to a test mode reminder signal generator 184 which generates a signal, in this case a periodic pulsed signal, distinctive of the fact that the system is in a test mode, which signal is delivered to test annunciator 176 and thus to either sounder 178 or light source 180. Additionally, a signal on line 182 enables gate 186 to permit the gating of an alarm condition indicating signal over line 134 to be applied to a sensor test alarm signal generator 188. Assuming that none of the sensors are violated at this time, the system proceeds to provide a distinctive signal indicative of the system being in a test mode until such time as an alarm condition indicating signal appears on line 134 as the result of the violation of one of the sensors of the system. This signal is gated through gate 186 to generator 188 which produces another distinctive signal, in this case a steady state signal, which is applied to the test annunciator. Simultaneously, an inhibit signal is applied over line 191 to generator 184 so that the test mode reminder signal is replaced with a sensor activation or sensor violation signal.

When a sensor is deactivated there will no longer be a signal on line 134 applied to generator 188 and the inhibit signal over line 190 will be removed there by reestablishing the test mode reminder signal.

Assuming that the user of the system wishes not only to self-test the test annunciators and the system indicators, but also wishes to test the local alarm annunciation system, then the user depresses test button 160 for a second time. This clocks counter 158 such that an output signal is applied to output line number 2. Output line number 2 and subsequent output lines are coupled to a timer 190 which upon actuation produces an output signal on line 192 for the timing period established by this timer. This in turn is coupled to panel light control unit 168 and operates in the same manner as the signal on line 166. Moreover, the signal on line 162 is also applied to generator 174 and again a signal on this line provides for the testing of test annunciator 176. Additionally, the signal on line 192 is applied to actuate generator 140 so as to actuate local alarm annunciator 142 in any desired mode. Thus, the second actuation of test button 160 provides for the testing of not only the system indicators and the test annunciator but also the local alarm annunciator. As mentioned hereinbefore it may be undesirable to do this at unauthorized times and therefore it is only after the second and subsequent actuations of test button 160 that these local alarm annunciators are actuated.

Timer 190, after timing out, provides a signal which is applied to line 182 which actuates generator 184 so as to provide a test mode reminder signal and also enables gate 186 so that walk or other testing may be annunicated by virtue of the changing of the format of the test mode reminder signal. At the same time the signal to generator 140 over line 192 ceases, thereby to deactivate generator 140.

In any event, whenever an output appears on lines 1, 2, . . . n of counter 158 an inhibit signal generator 200 is actuated to provide inhibit signals over lines 202 and 204 to inhibit the off-premises alarm communicator and the local alarm decoder. It should be noted that the inhibit signal generator does not inhibit sensor control and alarm condition detection unit 128 which is continuously operative to detect alarm condition signals from the sensors and to provide a signal via gate 186 to generator 188.

It is a feature of the subject that the second entry of a pass code as opposed to a test button resets counter 158. The effect of resetting counter 158 is to eliminate the test mode procedures. Thus, with no outputs on lines 1, 2 . . . n of counter 158 not only is the inhibit signal generator deactivated but also signals on lines 166, 192 and 182 cease thereby deactivating signal generators 174, 184 and 188 while at the same time removing the enable signal to panel light control 168. This is because removal of an output signal from counter 158 at the input of either timer 164 or 190 automatically resets the timers and removes any signals from the outputs thereof.

While this is one method of resetting generators 174,184 as well as resetting panel light control 168, it is of course possible to route the reset signal to all of these units so as to inactivate them. Note that generator 188 is not affected by the removal of signals on lines 166, 192 or 182 and remains operative were it not for gate 186. Gate 186 is disabled by the removal of the signal on line 182 which prevents actuation of generator 188. Thus, the application of a reset signal over line 156 to counter 158 in effect indirectly deactuates generator 188.

A system has therefore been provided for providing a distinctive indication that a system as a security system is in a test mode in which the distinctive indication includes audible and/or visual indications that a test sequence has been annunicated followed by testing of system sensors during the test sequence, with test results being indicated by altering the format of the audible or visible signal. In one embodiment involving a security system, a periodic signal is changed to a steady state signal when a sensor has been violated as, for instance, by walk testing of the sensor, thereby to provide a reminder that the system is in the test mode and also to provide for instantaneous communciation to the user of not only the operability of the sensor but also both the transmission of the sensors output to a central control unit and the operability of the control unit itself. When an access code is utilized to initiate a test sequence the access code entry a second time removes the system from the test mode as an added security precaution. Additionally, a self-test mode of operation may be automatically performed prior to full test in which the self-test includes testing all indicating and annunicating systems or only a portion thereof as desired.

The present invention is not to be limited in scope nor restricted in form except by the claims appended hereto.

What is claimed is:

1. A system for alerting the user of a security system to the placing of the security system in a walk test mode and the results of performing tests on the system comprising:

means responsive to said security system being placed in a walk test mode involving an individual moving from one local walk test location to another within a predetermined area of the security system to be tested for providing a first distinctive audible or visible test mode reminder signal throughout said predetermined area, said first signal being provided in such a manner that said first signal will be detected at a local walk test location by the individual performing the walk test; and means for changing said first signal to a different distinctive audible or visible signal throughout said predetermined area in such a manner that said different signal will be detected at a local walk test location by the individual performing the walk test, said different signal being provided responsive to said security system responding in a predetermined manner to the walk testing of said security system at local walk test locations.

2. The system of claim 1 wherein said security system includes sensors located throughout a facility at said local walk test locations, wherein said walk test including violating said sensors, and wherein said means for providing said different signal including means responsive to the deactivation of a sensor for reestablishing said first signal, whereby said alerting system follows the individual performing the walk test and alerts the individual to the operability of a violated and deactivated sensor.

3. The system of claim 1 wherein said security system includes a control unit and sensors located throughout a facility and wherein said different distinctive signal is provided responsive to a violation of a sensor, the transmission of the output signal generated by the violated sensor to the control unit and predetermined processing of said output signal by said control unit.

4. The system of claim 1 wherein said security system includes means for accessing said system responsive to an access code and means for taking said security system out of said test mode responsive to the provision of said access code to said security system.

5. The system of claim 4 wherein said security security system includes an off-premises communicator, means for inhibiting said off-premises communicator during said test mode, and means for reactivating said off-premises communicator responsive to the provision of said access code to said security system.

6. The system of claim 4 wherein said security system inclues an alarm condition annunciator, means for inhibiting said alarm condition annunciator during said test mode, and means for reactivating said alarm condition annunciator responsive to the provision of said access code to said security system.

7. The system of claim 1 wherein said meams for providing different signals includes means for altering said first signal so as to provide said different signal.

8. The system of claim 1 wherein said first signal is a periodic signal and wherein said different signal is a steady state signal.

9. The system of claim 1 wherein said first and different signals are audible throughout said predetermined area.

10. The system of claim 9 and further including means for self-testing said system prior to placing said system in a test mode.

11. The system of claim 10 wherein said system includes a test mode annunciator and indicator, and an alarm condition annunciator, and wherein said self-testing means includes means for selectively activating only said test mode annunciator and indicator during a predetermined time period.

12. The system of claim 11 wherein said selective activating means includes manually actuatable switch means, for activating said test mode annunciator and indicator responsive to a first actuation of said switch means, and means for activating said test mode annunicator and indicator and said alarm condition annunciator responsive to a second actuation of said switch means.

13. A system for alerting the user of a signaling system to the placing of the signaling system in a test mode and the results of performing tests on the system comprising:

means responsive to said signaling system being placed in a test mode for providing a first distinctive recognizable signal throughout a predetermined area of the signaling system; and means for providing a different recognizable signal throughout said predetermined area responsive to said signaling system responding in a predetermind manner to the testing of said signaling system.

* * * * *

UNITED STATES PATENT AND TRADEMARK OFFICE

CERTIFICATE OF CORRECTION

PATENT NO. : 4,412,211

DATED : October 25, 1983

INVENTOR(S) : William J. Lautzenheiser et al

It is certified that error appears in the above—identified patent and that said Letters Patent is hereby corrected as shown below:

Column 2, line 38, "instance a" should read --instance, a--;
line 42, "This followed" should read --This is followed--;
line 67, "and/or remotely" should read --and/or a remotely--.

Column 3, line 3, "predetermind" should read --predetermined--;
line 10, "they working, with" should read --they are working with--;
line 25, "mens" should read --means--.

Column 4, line 17, "test, with" should read --test with--.

Column 5, line 36, "all alarms" should read --all local alarms--.

Column 7, line 11, "but the" should read --but also the--.

Column 10, line 3, "there by" should read --thereby--;
line 48, "subject that" should read --subject system that--.

Column 11, lines 56-57, "including" should read --includes--.

Column 12, lines 13-14, "said security security system" should read --said security system--;
line 20, "inclues" should read --includes--;

UNITED STATES PATENT AND TRADEMARK OFFICE

CERTIFICATE OF CORRECTION

PATENT NO. : 4,412,211

DATED : October 25, 1983

INVENTOR(S) : William J. Lautzenheiser et al

It is certified that error appears in the above—identified patent and that said Letters Patent is hereby corrected as shown below:

Column 12, line 59, "different recognizable" should read --different distinctive recognizable--;
line 61, "predetermind" should read --predetermined--.

Signed and Sealed this

Twentieth Day of March 1984

[SEAL]

Attest:

GERALD J. MOSSINGHOFF

Attesting Officer

Commissioner of Patents and Trademarks

UNITED STATES PATENT AND TRADEMARK OFFICE

CERTIFICATE OF CORRECTION

PATENT NO. : 4,412,211

DATED : October 25, 1983

INVENTOR(S) : William J. Lautzenheiser et al

It is certified that error appears in the above—identified patent and that said Letters Patent is hereby corrected as shown below:

Please correct the name of the Assignee from:

American District Telegraph Co.

to

American District Telegraph Company

Signed and Sealed this

*Eighteenth* Day of *December 1984*

[SEAL]

*Attest:*

GERALD J. MOSSINGHOFF

*Attesting Officer*

*Commissioner of Patents and Trademarks*